US005712221A

United States Patent [19]

Goto et al.

[11] Patent Number: 5,712,221

[45] Date of Patent: Jan. 27, 1998

[54] THERMAL RECORDING MEDIUM

[75] Inventors: Hiroshi Goto, Fuji; Ichiro Sawamura, Numazu, both of Japan

[73] Assignee: Ricoh Company, Ltd., Tokyo, Japan

[21] Appl. No.: 649,110

[22] Filed: May 17, 1996

[30] Foreign Application Priority Data

May 19, 1995 [JP] Japan ..... 7-121529
May 7, 1996 [JP] Japan ..... 8-112616

[51] Int. Cl.[6] ..... B41M 5/40

[52] U.S. Cl. ..... 503/226; 427/152

[58] Field of Search ..... 427/152; 503/200, 503/226

[56] References Cited

U.S. PATENT DOCUMENTS 5,380,693 1/1995 Goto ..... 503/200
5,403,810 4/1995 Sawamura et al. ..... 503/201
5,432,534 7/1995 Maruyama et al. ..... 347/172
5,521,138 5/1996 Shimada et al. ..... 503/209
5,532,201 7/1996 Goto ..... 503/213

*Primary Examiner*—Bruce H. Hess
*Attorney, Agent, or Firm*—Oblon, Spivak, McClelland, Maier & Neustadt, P.C.

[57] ABSTRACT

A thermal recording medium includes a thermal recording layer, which is provided on a transparent substrate, consisting essentially of an electron-donating chromophoric compound, an electron-accepting compound and a binder resin, an over layer, whose dynamic friction coefficient of the surface does not exceed 0.1, includes a resin having substantially the same refractive index as the thermal recording layer is further provided.

14 Claims, No Drawings

THERMAL RECORDING MEDIUM

BACKGROUND OF THE INVENTION

1. Field of the Invention

The present invention relates to a thermal recording medium based on a coloration reaction of an electron-donating chromophoric compound with an electron-accepting compound and, in particular, a transparent thermal recording medium which is useful for a sheet of a block copy film (for image forming) for plate-making in gravure printing, offset lithography and screen process printing, especially screen process printing for textiles. Also, the present invention relates to a transparent thermal recording medium which is useful for an image-forming film sheet for an overhead projector (hereinafter referred to as an "OHP") and an image-forming film sheet for a CAD system.

2. Description of the Related Art

The thermal recording medium which is based on the coloration reaction of the electron-donating chromophoric compound (hereinafter also referred to as a "color-producing agent") with the electron-accepting compound (hereinafter also referred to as a "developer") is well known in the art.

Application of such medium has been expanding in many fields these days and there is a demand for such medium for various purposes such as the OHP, a sub origin in diazo process and designing of drawings. Furthermore, the thermal recording medium has been used for the block copy film for gravure printing, offset lithography and screen printing.

In general, the following properties are required for the block copy films:

(1) shielding ultraviolet rays of a portion that should shield the ray and transmitting the rays of a portion where it should transmit the ray, (2) maintenance of ultraviolet ray shielding and transmittance property under the conditions of temperature, moisture and light (preservability), (3) readiness for visual inspection when a shear or miss in printing is checked by superimposing some of the films (inspectability), (4) size accuracy (also called "precision", i.e., when a pieces of print materials are printed using the same block copy film and if there is no shear of printed image among the printed material, it is said that the size accuracy is good), (5) high resolution and (6) physical strength for withstanding repeatable use.

The transparent thermal recording medium on which an image may directly be recorded using a thermal head is described in the Japanese Laid-Open Patent Application No.1-99873. In order to produce such transparent thermal recording medium, however, complicated processes are required and that has been a problem. For example, a micro-capsulation of a color-producing agent is first needed to be carried out and then application liquid comprising an emulsified dispersion material formed by emulsifying and dispersing the micro-capsulated color-producing agent into an organic solvent, in which a developer is dissolved, which is insoluble or slightly soluble in water is required to be applied onto a transparent substrate. Moreover, a transparency of the thus obtained thermal recording medium is often insufficient.

There are other types of transparent thermal recording media which have good transparency, however, the stability of a colored image formed on such medium by applying thermal energy is not satisfactory. Also, if they are used for the above-mentioned sheet of a block copy film for print plate-making, a good contrast between the color-producing imaging portion and non-imaging portion at wavelengths ranging from 370 nm to 450 nm is not obtained, and therefore they cannot be used for block copy film for a photosensitive plate-making when a lamp whose wavelength lies between 370 nm and 450 nm is used. Furthermore, there is another problem for the conventional transparent thermal recording medium that a coloring tone of most such media is black and it is not easy to recognize a shear between traced images formed on the respective films during an inspection of the block copy films on which images are formed using, for example, an automatic tracer. This is because the colored image portions look like black due to their strong tendency to absorb light of 450 to 600 nm wavelength which is readily recognized by the naked eyes and it makes difficult to judge if the imaged portions are superimposed or not.

SUMMARY OF THE INVENTION

Accordingly, it is a general object of the present invention to provide a novel thermal recording medium in which the above-mentioned problems are eliminated.

A more specific object of the present invention is to provide a thermal recording medium based on a coloration reaction of an electron-donating chromophoric compound with an electron-accepting compound, having an excellent friction coefficient.

It is another object of the present invention to provide a thermal recording medium having an excellent head matching ability relating to size accuracy and a superb antistatic property.

It is also another object of the present invention to provide a thermal recording medium with high reliability which has no sticking problems caused by contact with the thermal head.

It is also another object of the present invention to provide a thermal recording medium in which a surface resistance of a reverse side of the thermal recording medium is improved.

The objects described above are achieved by a thermal recording medium comprising a thermal recording layer provided on a transparent substrate, consisting essentially of an electron-donating chromophoric compound, an electron-accepting compound and a binder resin, wherein an over layer, having a surface dynamic friction coefficient no greater than 0.1, comprising a resin having a refractive index substantially the same as a refractive index of the thermal recording layer.

According to the above thermal recording medium, since the dynamic friction coefficient of the surface of the over layer does not exceed 0.1, attachment of dregs to a thermal head may be prevented. Also, according to the above thermal recording medium, high reliability and head matching capability may be obtained and a sticking problem caused by contact with the thermal head may be avoided. Further, according to the above thermal recording medium, an image-formed block copy film to be useful for a block copy film sheet for plate-making may be obtained.

The objects described above are also achieved by the thermal recording medium described above wherein the over layer is comprised of a protective layer and a skid layer and the dynamic friction coefficient of said skid layer does not exceed 0.05.

According to the above thermal recording medium, since the over layer is comprised of the protective layer and the skid layer and the dynamic coefficient of the skid layer is equal to or less than 0.05, the size accuracy and the precision required for a block copy film for textile printing may be achieved.

The objects described above are also achieved by the thermal recording medium described above wherein the dynamic friction coefficient of a reverse side of the thermal recording medium is at least 0.1.

The objects described above are also achieved by the thermal recording medium described above wherein a surface resistance value of a reverse side of the thermal recording medium does not exceed $10^8\Omega$.

The objects described above are also achieved by the thermal recording medium described above wherein the binder resin contains one of hydroxyl groups and carboxyl groups in a molecule thereof and has a refractive index ranging from 1.45 to 1.60 at ordinary temperature.

According to the above thermal recording medium, since the dynamic friction coefficient and the surface resistance value of the reverse side of the thermal recording medium is equal to or more than 0.1 and equal to or less than $10^8\Omega$, respectively, a feeding roller does not slip or idle and a film may be fed to a predetermined position accurately.

The objects described above are also achieved by the thermal recording medium described above wherein the skid layer is comprised of a resin in which silicone segments are joined together in one of blockwise and graftwise.

The objects described above are also achieved by the thermal recording medium described above wherein the resin is selected from a group consisting of an acrylate resin in which silicone segments are joined together in one of blockwise and graftwise, a methacrylate resin in which silicone segments are joined together in one of blockwise and graftwise, polyvinyl butyral resin in which silicone segments are joined together in one of blockwise and graftwise, polyvinyl acetal resin in which silicone segments are joined together in one of blockwise and graftwise, cellulose acetate propionate resin in which silicone segments are joined together in one of blockwise and graftwise, ethyl cellulose resin in which silicone segments are joined together in one of blockwise and graftwise and polyurethane type resin in which silicone segments are joined together in one of blockwise and graftwise.

According to the above thermal recording medium, since the silicone segments are bonded as mentioned above, the contact (frictionless) between the recording medium and a thermal head may be maintained in excellent condition. Also, as the silicone molecules are copolymerized in the resin, an attachment of dregs to a thermal head may be prevented.

Other objects and further features of the present invention will be apparent from reading the following detailed description.

DESCRIPTION OF THE PREFERRED EXAMPLES

The thermal recording medium according to the present invention is described in detail hereinafter.

The electron-accepting compound which may be used in the present invention is not particularly limited and examples of such compound include organophosphoric acid compounds having the following general formula (I) or (II).

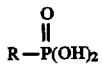

(I)

(where R represents a linear alkyl group having 16 to 24 carbon atoms.)

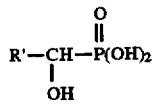

(II)

(where R' represents a linear alkyl group having 13 to 23 carbon atoms.)

Examples of the electron-donating chromophoric compound may be used in the present invention include fluoran compounds having the following general formula (III), (IV), (V), (VI), (VII) or (VIII).

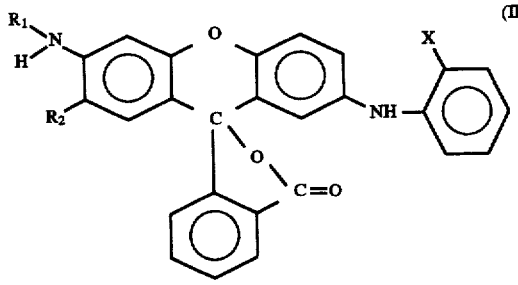

(III)

(where $R_1$ represents an alkyl group having no more than 8 carbon atoms, $R_2$ represents a hydrogen atom or an alkyl group having no more than 4 carbon atoms, and X represents a halogen atom such as fluorine, chlorine and bromine.)

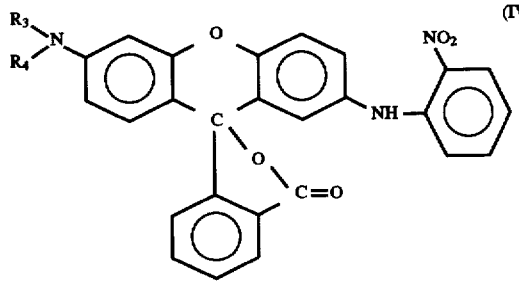

(IV)

(where $R_3$ represents a hydrogen atom or an alkyl group having no more than 8 carbon atoms, $R_4$ represents an alkyl group having no more than 8 carbon atoms.)

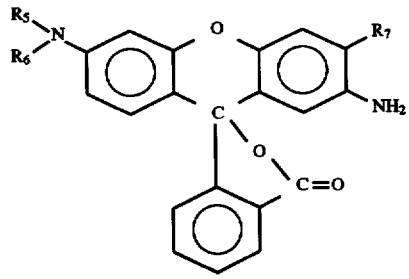

(V)

(where $R_5$ and $R_6$ represent alkyl groups having no more than 8 carbon atoms, and $R_7$ is selected from the group consisting of a hydrogen atom, lower alkyl groups and lower alkoxy groups.)

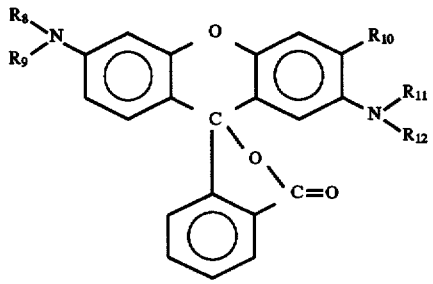

(VI)

(where $R_8$ is a hydrogen atom, $R_9$ represents an alkyl group having no more than 8 carbon atoms, $R_{10}$ is selected from the group consisting of a hydrogen atom, lower alkyl groups and lower alkoxy groups, $R^{11}$ represents a hydrogen atom or an alkyl group having no more than 8 carbon atoms and $R_{12}$ is selected from the group consisting of alkyl groups having no more than 8 carbon atoms, phenyl groups and substituted phenyl groups.)

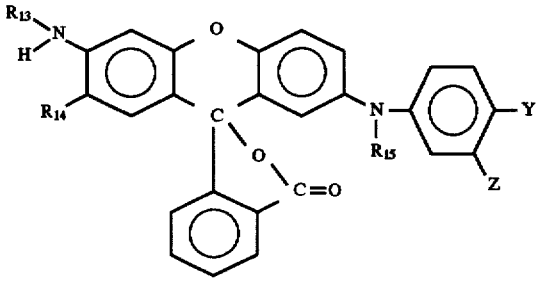

(VII)

(where $R_{13}$ represents an alkyl group having no more than 8 carbon atoms, $R_{14}$ represents a methyl or ethyl group and $R_{15}$ is a hydrogen atom or an alkyl group having no more than 4 carbon atoms. Y and Z are selected from the group consisting of hydrogen atoms and halogen atoms such as fluorine, chlorine and bromine.)

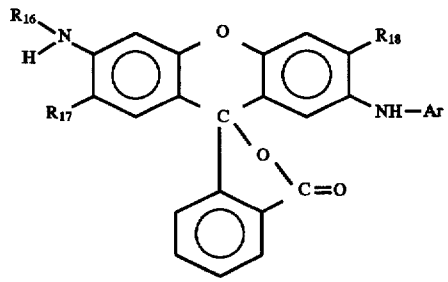

(VIII)

(where $R_{16}$ represents an alkyl group having no more than 8 carbon atoms, $R_{17}$ represents a methyl or ethyl group and $R_{18}$ is a hydrogen atom or an alkyl group having no more than 4 carbon atoms. Y and Z are selected from the group consisting of hydrogen atoms and halogen atoms such as fluorine, chlorine and bromine. Ar represents a phenyl or benzyl group.)

When the thermal recording medium according to the present invention is used as a block copy, a high size accuracy is required as the block copy film is produced and when the produced block copy film is baked. There are many factors which may affect the quality of the produced film and some of them exist in an apparatus which is used for producing the film. Examples of such factors include accuracy of feeding speed of the film and preciseness of positioning a heat source. What is meant by the accuracy of a feeding speed of the film may be divided in two parts: one is a simple and mere accuracy of the feeding speed due to performance of a device, and the other is an inconstancy of the feeding speed caused by friction or heat sealing between the surface of the film sheet and a thermal head if it is used as a heat source. Also, the feeding speed could be affected by a change in room temperature or temperature of the interior of a device used, or a stretching or contracting of film caused by such temperature changes. Moreover, the feeding speed is affected by a change in tension due to electrification of the film or a change in the diameter of a film roll when a roll-type film is fed. Further, the feeding speed is also affected by an expansion of the block copy film due to heat from a baking lamp used for baking the block copy film.

The precision (size accuracy) required for a block copy film for textile printing is equal to or less than ±0.05 mm/600 mm (i.e, the error among printed materials is equal to or less than ±0.05 mm when the length of print is 600 mm). As mentioned above, if a thermal head is used as the heat source, the precision may be lowered by considerations such as the friction or the heat sealing generated between the surface of a film and the thermal head, stretching or contracting of film due to changes in temperature of the surroundings or of the apparatus used and the electrification of the film. Among those factors, the effect of the friction generated between the surface of the film and the thermal head is especially large and the scale of the friction may be expressed by a friction coefficient of a surface of the film. The Japanese Laid-Open Patent Application No.5-92658, for example, describes a method for preventing generation of scratches on a surface of a recording layer and attachment of thermal head dregs to a thermal head by making a dynamic friction coefficient of the surface of a recording layer equal to or less than 0.1.

The term "(dynamic) friction coefficient" used in this specification may be defined as a value obtained by dividing a force applied to a stainless ball of 3 mm diameter in the horizontal direction when the ball is put on a surface of a sample horizontally placed and moved at a speed of 1.0 mm/sec. for 10 mm with an applied load of 50 g at ordinary temperature, by the value of the load.

It was found that the precision required for a normal use such as facsimile or a thermal printer may be achieved sufficiently by making the friction coefficient of the recording layer surface equal to or less than 0.4. However, if the friction coefficient is about 0.1 for the above mentioned purposes, although an improvement can be achieved in some degree, it is difficult to obtain a significant improvement and it was found that at least less than 0.05 of the friction coefficient is required for these purposes. Moreover, it was also found that if the friction coefficient of a reverse side of the recording medium is less than 0.1, a feeding roller slips or idles and cannot feed the film properly. Thus, the film is not positioned accurately and so the size accuracy is lowered. Therefore, at least 0.1 of the friction coefficient is required for the reverse side of the recording medium.

The thermal recording medium of the present invention is described in detail hereinafter.

The electron-donating chromophoric compound may be used in the present invention is not particularly limited and may be an achromatic or pale dye precursor including known fluoran compounds such as follows:

3-diethylamino-7-anilinofluoran,
3-di-n-butylamino-7-anilinofluoran,
3-(N-n-hexyl-N-ethylamino)-7-anilinofluoran,
3-diethylamino-7-dibenzylaminofluoran,
3-diethylamino-5-methyl-7-dibenzylaminofluoran, 3-diethylamino-7-piperidinofluoran,
3-diethylamino-7-(o-chloranilino)fluoran,
3-di-n-butylamino-7-(o-chloranilino)fluoran,
3-dimethylamino-6-methyl-7-anilinofluoran,
3-diethylamino-6-methyl-7-anilinofluoran,
3-di-n-butylamino-6-methyl-7-anilinofluoran,
3-(N-n-propyl-N-methylamino)-6-methyl-7-anilinofluoran,
3-(N-n-iso-propyl-N-methylamino)-6-methyl-7-anilinofluoran,
3-(N-n-butyl-N-ethylamino)-6-methyl-7-anilinofluoran,
3-(N-iso-butyl-N-methylamino)-6-methyl-7-anilinofluoran,
3-(N-n-amyl-N-methylamino)-6-methyl-7-anilinofluoran,
3-(N-iso-amyl-N-ethylamino)-6-methyl-7-anilinofluoran,
3-(N-cyclohexyl-N-methyl)-6-methyl-7-anilinofluoran,
3-(N-n-amyl-N-ethylamino)-6-methyl-7-anilinofluoran,
3-(N-p-tolyl-N-ethylamino)-6-methyl-7-anilinofluoran,
3-(N-2-ethoxypropyl-N-ethylamino)-6-methyl-7-anilinofluoran,
3-pyrrolidino-6-methyl-7-anilinofluoran
3-(N-tetrahydrofurfuryl-N-ethylamino)-6-methyl-7-anilinofluoran,
3-diethylamino-7-(m-trifluoromethylanilino)fluoran,
3-diethylamino-6-methyl-7-(2',4'-dimethylanilino)fluoran,
3-diethylamino-6-chloro-7-anilinofluoran,
3-diethylamino-5-methyl-7-(α-phenylethylamino)fluoran and
3-(N-p-tolyl-N-ethylamino)-7-(α-phenylethylamino) fluoran.

A color-producing agent which is preferably used according to the present invention is a fluoran compound having the afore-described formula (III), (IV), (V), (VI), (VII) or (VIII) and the examples of such compounds are as follows.

[Examples of compounds having the general formula(III)]

2-(O-chlorophenylamino)-6-ethylamino-7-methylfluoran,
2-(O-chlorophenylamino)-6-n-butylamino-7-methylfluoran,
2-(O-florophenylamino)-6-ethylamino-7-methylfluoran,
2-(O-chlorophenylamino)-6-n-butylaminofluoran,
2-(O-chlorophenylamino)-6-n-hexylaminofluoran,
2-(O-chlorophenylamino)-6-n-octylaminofluoran,
2-(O-florophenylamino)-6-iso-amylaminofluoran,
2-(O-florophenylamino)-6-n-octylaminofluoran.

[Examples of compounds having the general formula(IV)]

2-(0-nitrophenylamino)-6-diethylaminofluoran,
2-(0-nitrophenylamino)-6-di-butylaminofluoran,
2-(0-nitrophenylamino)-6-(N-ethyl-N-n-butylamino) fluoran,
2-(0-nitrophenylamino)-6-(N-ethyl-N-iso-amylamino) fluoran.

[Examples of compounds having the general formula(V)]

2-amino-6-diethylaminofluoran,
2-amino-6-di-n-butylaminofluoran,
2-amino-3-methyl-6-diethylaminofluoran,
2-amino-3-methyl-6-di-n-butylaminofluoran,
2-amino-3-methyl-6-(N-ethyl-N-iso-amylamino)fluoran,
2-amino-3-methoxy-6-diethylaminofluoran,
2-amino-3-methoxy-6-di-n-butylaminofluoran.

[Examples of compounds having the general formula(VI)]

2-methylamino-6-n-butylaminofluoran,
2-n-butylamino-6-n-butylaminofluoran,
2-n-octylamino-6-n-ethylaminofluoran,
2-n-octylamino-3-methyl-6-n-butylaminofluoran,
2-phenylamino-6-ethylaminofluoran,
2-phenylamino-6-n-butylaminofluoran,
2-phenylamino-6-n-octylaminofluoran,
2-phenylamino-3-methyl-6-n-butylaminofluoran,
2-phenylamino-3-methyl-6-ethylaminofluoran,
2-phenylamino-3-methyl-6-n-hexylaminofluoran,
2-phenylamino-3-methyl-6-n-amylaminofluoran,
2-phenylamino-3-methyl-6-iso-amylaminofluoran,
2-phenylamino-3-methyl-6-n-octylaminofluoran,
2-phenylamino-3-methoxy-6-n-butylaminofluoran,
2-phenylamino-3-methoxy-6-n-hexylaminofluoran.

[Examples of compounds having the general formula(VII)]

2-(3',4'-dichlorophenylamino)-6-ethylamino-7-methylfluoran,
2-(3',4'-dichlorophenylamino)-6-n-butylamino-7-methylfluoran,
2-(3'-chloro-4'-fluorophenylamino)-6-ethylamino-7-methylfluoran,
2-(N'-methyl-N-3'-chlorophenylamino)-6-ethylamino-7-methylfluoran,
2-(N-ethyl-N-3'-chlorophenylamino)-6-ethylamino-7-methylfluoran,
2-(N-methyl-N-4'-chlorophenylamino)-6-ethylamino-7-methylfluoran.

[Examples of compounds having the general formula(VIII)]

2-phenylamino-3-methyl-6-ethylamino-7-methylfluoran,
2-phenylamino-3-methyl-6-n-butylamino-7-methylfluoran,
2-phenylamino-3-ethyl-6-ethylamino-7-methylfluoran,
2-benzylamino-3-methyl-6-ethylamino-7-methylfluoran,
2-phenylamino-3-chloro-6-ethylamino-7-methylfluoran,
2-phenylamino-3-chloro-6-N-butylamino-7-methylfluoran,
2-benzylamino-3-chloro-6-ethylamino-7-methylfluoran.

According to the present invention, it is preferable to use a phenolic compound or organophosphoric acid compound, which is insoluble or slightly soluble to a normal solvent, as the developer for coloring the color producing agent and examples of the phenolic compound include gallic acid compound, protocatechuic acid compound and bis (hydroxyphenyl)acetic acid. Examples of the organophosphoric acid compound include alkylphosphonic acid compound and α-hydroxyalkyl phosphonic acid. Among them, the organophosphoric acid compounds are superior in terms of surface blushing and thermal sensitivity.

Phosphonic acid of the following general formula (I) or (II) is used as preferable organophosphoric acid compound.

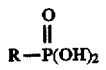

(I)

(where R represents an linear alkyl group having 16 to 24 carbon atoms.)

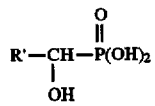

(II)

(where R' represents an linear alkyl group having 13 to 23 carbon atoms.)

Examples of the phosphonic acid having the above general formula (I) include following compounds:

hexadecylphosphonate, octadecylphosphonate, eicosylphosphonate, docosylphosphonate and tetracosylphosphonate.

Examples of the phosphonic acid having the above general formula (II) include following compounds:

α-hydroxytetradecylphosphonate,
α-hydroxyhexadecylphosphonate,
α-hydroxyoctadecylphosphonate,
α-hydroxyeicosylphosphonate and
α-hydroxytetracocylphosphonate.

According to the present invention, only one or a mixture of two or more developers may be used. Also, only one or a mixture of two or more color-producing agents may be employed.

The average particle size of the developer used in the present invention is preferably 10 μm or less. It is most preferably to use a developer whose average particle size is 1 μm or less and particles of more than 1 μm are not included in it in order to improve the thermal sensitivity and a resolution of thermal recording medium.

Binder resin may be used for the thermal recording layer and is preferably a resin which has the ability to provide sufficient protons around the dye molecule of color-producing agent in order to stabilize it and maintain its color when the color-producing agent is reacted with the developer by thermal energy or the like, and the ring of the molecule is opened by a proton-attack of the developer. The binder resin, more preferably, is a resin compound whose refractive index is in the range of 1.45 to 1.60 at ordinary temperature.

Examples of such binder resin include polyvinylbutylal (1.48 to 1.49), polyvinylacetal (1.50), epoxy resin (1.55 to 1.61), ethyl cellulose (1.46 to 1.49), cellulose acetate (1.46 to 1.50), cellulose acetate butylate (1.46 to 1.49), cellulose acetate propyonate (1.46 to 1.49), nitrocellulose (1.49 to 1.51) and a copolymer of styrene-maleic acid (1.50 to 1.60). Moreover, a similar environment to the above mentioned binder resin can be created if an acidic material in a binder resin, an ultraviolet absorber having hydroxyl and carboxyl groups, antioxidant, anti-aging agent, and so on exist in the recording layer.

An improvement in light stability of the thermal recording medium according to the present invention may be achieved by including a light stabilizer in the thermal recording layer or an over layer. Examples of the light stabilizers may be used in the present invention include ultraviolet absorbers, antioxidants, anti-aging agents, extinctive agents of the singlet oxygen and extinctive agents of the superoxide anion.

Examples of the ultraviolet absorber include a benzophenone ultraviolet absorber such as 2,4-dihydroxybenzophenone,
2-hydroxy-4-methoxybenzophenone,
2-hydroxy-4-n-octoxybenzophenone,
4-dodecyloxy-2-hydroxybenzophenone,
2,2'-dihydroxy-4-methoxybenzophenone,
2,2'-dihydroxy-4,4'-dimethoxybenzophenone,
2,2',1,4'-tetrahydroxybenzophenone,
2-hydroxy-4-methoxy-2'-carboxybenzophenone,
2-hydroxy-4-oxybenzylbenzophenone,
2-hydroxy-4-chlorobenzophenone,
2-hydroxy-5-chlorobenzophenone,
2-hydroxy-4-methoxy-4'-methylbenzophenone,
2-hydroxy-4-n-heptoxybenzophenone,
2-hydroxy-3,6-dichloro-4-methoxybenzophenone,
2-hydroxy-3,6-dichloro-4-ethoxybenzophenone and
2-hydroxy-4-(2-hydroxy-3-methylacryloxy) propoxybenzophenone;

a benzotriazol ultraviolet absorber such as 2-(2'-hydroxy-5'-methylphenyl)benzotriazol,
2-(2'-hydroxy-3',5'-di-tertiary-butylphenyl)benzotriazol,
2-(2'-hydroxy-3'-tertiary-butyl-5'-methylphenyl) benzotriazol,
2-(2'-hydroxy-4'-octoxy)benzotriazol,
2-(2'-hydroxy-3',5'-di-tertiary- butylphenyl)5-chlorobenzotriazol,
2-(3'-tertiary-butyl-2'-hydroxy-5'-methylphenyl)5-chlorobenzotriazol and
2-(2'-hydroxy-5-ethoxyphenyl)benzotriazol;

a salicylic acid phenyl ester ultraviolet absorbed such as phenyl salicylate, p-octylphenyl salicylate, p-tertiary-butylphenyl salicylate, carboxylphenyl salicylate, methylphenyl salicylate and dodecylphenyl salicylate; p-methoxybenzyliden malonic acid dimethyl ester, 2-ethylhexyl-2-cyano-3,3'-diphenylacrylate, 3,5-ditertiary-butyl-p-hydroxybenzoic acid, resorcinol monobenzoate, 2,4-ditertiary-butylphenyl, 3,5-ditertiary-butyl-4-hydroxybenzoate, etc.

Examples of the antioxidant and anti-aging agent include 2,6-ditertiary-butyl-4-methylphenol, 2,4,6-tritertiarybutylphenol, styrene modified phenol, 2,2'-methylenebis(4-methyl-6-tertiarybutylphenol), 4,4'-isopropylidene-bisphenol, 2,6-bis(2'-hydroxy-3'-tertiarybutyl-5'-methylbenzyl)-4-methylphenol, 4,4'-thiobis-(3-methyl-6-tertiarybutylphenol), tetrakis-(methylene(3,5-ditertiarybutyl-4-hydroxyhydrocinnamate))methane, parahydroxyphenyl-3-naphthylamine, 2,2,4-trimethyl-1,2-dihydroquinoline, thiobis(β-naphthol), mercaptobenzothiazole, mercaptobenzimidazole, aldol-2-naphthylamine, bis(2,2,6,6-tetramethyl-4-piperidyl) sebacate, 2,2,6,6-tetramethyl-4-piperidylbenzoate, dilauryl-3,3'-thiodipropionate, distearyl-3,3'-thiodipropionate, tris((4-nonylphenol)phosphate, etc.

Carotenes, pigments, amines, phenols, complex of nickel and sulfide may be used as extinctive agents of the singlet oxygen and examples of them include 1,4-diazabicyclo(2,2,2)octane, β-carotene,
1,3-cyclohexadiene, 2-diethylaminomethylfuran,
2-phenylaminomethylfuran,
9-diethylaminomethylanthracene,
5-diethylaminomethyl-6-phenyl-3,4-dihydroxypyran,
nickel dimethyldithiocarbamate,
nickel dibutyldithiocarbamate,
nickel-3,5-di-t-butyl-4-hydroxybenzyl-o-ethylphosphonate,
nickel-3,5-di-t-butyl-4-hydroxybenzyl-o-butylphosphonate,
nickel (2,2'-thiobis(4-t-octylphenolate))(n-butylamine),
nickel(2,2'-thiobis(4-t- octylphenolate))(2-ethylhexylamine),
nickel bis(2,2'-thiobis(4-t-octylphenolate)),
nickel bis(2,2'-sulfonebis(4-octylphenolate)),
nickel bis(2-hydroxy-5-methoxyphenyl-N-n-butylaldoimine),
nickel bis(dithiobenzyl),
nickel bis(dithiobiacetyl), etc.

Examples of the extinctive agent of the superoxide anion include superoxide dismutase and a complex of cobalt[III]

and nickel[II], and they may be used solely or as a mixture of two or more. However, the present invention is not so limited.

A substrate of the thermal recording medium according to the present invention is a transparent support having a refractive index preferably ranging from 1.45 to 1.60 at ordinary temperature. In general, a polyester film made of polyethylene terephthalate, polybutylene terephthalate, etc., a cellulose derivative film made of cellulose triacetate, etc., a polyolefin film made of polypropylene, polyethylene, etc., a polystyrene film or laminate thereof is used as the transparent support.

It is preferable that an adhesive layer is inserted between the thermal recording layer and the transparent substrate. Acryl resin, saturated polyester resin or hardened resin thereof is generally used as a constituent of the adhesive layer.

If a thermal recording medium has no over layer, the surface and the inside of its thermal recording layer becomes heterogeneous since fine particles of the developer are dispersed in the binder resin and the layer appears to be opaque due to the scattering of light generated by the differences in the refractive index among the recording layer, the surface of the recording layer and the air present in voids. However, by applying homogeneously a resin which has the same or substantially the same refractive index as the binder resin of the thermal recording layer onto the recording layer and drying (hardening) it as in the present invention, the voids of the recording layer are eliminated and the surface is smoothen and a transparent recording medium which has little scattering of light may be obtained. The protective layer thus produced not only contributes to the transparency of the recording medium, but also has great effect in improving chemical resistance, water resistance, abrasion resistance, light fastness and a head matching property. The protective layer, therefore, is an essential component for a high performance transparent thermal recording medium.

The protective layer or the over layer according to the present invention comprises a coating formed principally of a water-soluble resin or a hydrophobic resin or a coating formed principally of an ultraviolet curable resin or an electron beam curable resin. A recording medium which has no practical problems in contact with organic solvents, plasticizers, oils, sweat, water, etc., may be obtained by the formation of the protective layer or the over layer. Moreover, a thermal recording medium with high reliability and head matching quality, which has no sticking problems caused by contact with the thermal head, may be obtained according to the present invention.

The over layer and the protective layer according to the present invention are described in detail hereinafter.

curable resins are included as such resin. Examples of the water-soluble resin include polyvinyl alcohol, denatured polyvinyl alcohol, cellulose derivatives (methylcellulose, methoxycellulose, hydroxyethylcellulose, etc.), casein, polyvinyl pyrrolidone, styrene-maleic anhydride copolymer, diisobutylene-maleic anhydride copolymer, polyacrylamide, modified polyacrylamide, methylvinyl ether-maleic anhydride copolymer, carboxy modified polyethylene, polyvinyl alcohol/acrylamide block copolymer, melamine-formaldehyde resin, urea-formaldehyde resin, etc. Examples of the aqueous emulsion and hydrophobic resin include polyvinyl acetate, polyurethane, styrene/butadiene copolymer, styrene/butadiene/acryl copolymer, polyacrylic acid, polyacrylate, vinylchloride/vinylacetate copolymer, polybutyl methacrylate, ethylene/vinylacetate copolymer, etc. They may be used solely or as a mixture and a hardener may be added to cure the resin if necessary.

The ultraviolet curable resin and electron beam curable resin which are most preferable for the over layer and the protective layer according to the present invention are described in detail hereinafter.

The ultraviolet curable resins may be used for the formation of the over layer and the protective layer are any known monomers or oligomers (or prepolymers) which may be hardened by a polymerization reaction caused by an irradiation of ultraviolet ray. Examples of such monomer or oligomer include (poly)ester acrylate, (poly)urethane acrylate, epoxy acrylate, polybutadiene acrylate, silicone acrylate and melamine acrylate. A (poly)ester acrylate is prepared by a reaction of polyhydric alcohol such as 1,6-hexanediol, propylene glycol (as a propylene oxide) and diethylene glycol, with a polybasic acid such as adipic acid, phthalic anhydride and trimellitic acid, and with acrylic acid. Examples of structural formula of such (poly)ester acrylate (a) to (c) are shown below.

(a) adipic acid/1,6-hexanediol/acrylic acid $$CH_2{=}CHCOO(CH_2)_6[O{-}CO(CH_2)_4COO(CH_2)_6]_nOCOCH{=}CH_2$$

(where n represents an integer from 1 to 10)

(b) phthalic anhydride/propylene oxide/acrylic acid

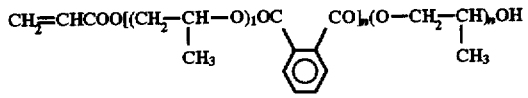

(where l, m and n represent an integer from 1 to 10, respectively)

(c) trimellitic acid/diethylene glycol/acrylic acid

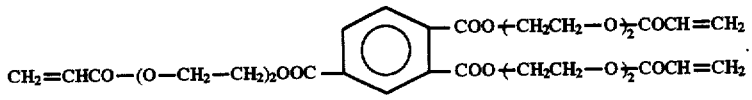

According to the present invention a resin which has the same refractive index as the binder resin forming the thermal recording layer is used for forming the over layer and the protective layer.

The term "same refractive index" used above is defined as essentially the same refractive index inclusive of about ±5% error. The refractive index is preferably in the range of 1.45 to 1.60 at ordinary temperature.

Besides water-soluble resins, aqueous emulsions, hydrophobic resins, ultraviolet curable resins and electron beam (Poly)urethane acrylate is prepared by the reaction of a isocyanate oriented compound such as tolylene diisocyanate (TDI) with an acrylate having hydroxy group(s). An example of structural formula (d) is shown below. The abbreviations HEA, HDO and ADA represent 2-hydroxyethylacrylate, 1,6-hexanediol and adipic acid, respectively.

(d) HEA/TDI/HDO/ADA/HDO/TDI/HEA

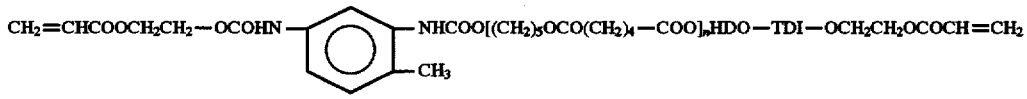

(where n represents an integer from 1 to 10)

Epoxy acrylate is generally categorized into hisphenol A type, novolac type and alicyclic type, and epoxy groups of these epoxy resin are esterified by acrylic acid and functional groups are modified to acryloyl groups. Examples of structural formula (e) to (g) are shown below.

(e) bisphenol-A epichlorohydrin type/acrylic acid

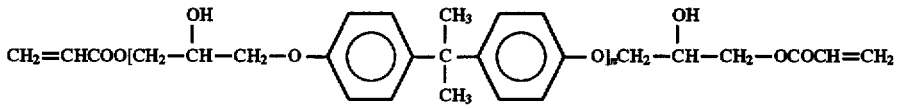

(where n represents an integer from 1 to 15)

(f) phenolnovolac epichlorohydrin type/acrylic acid

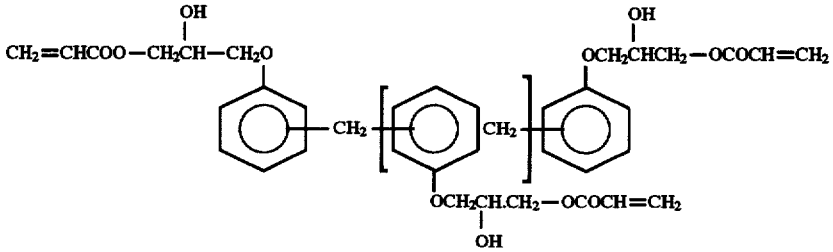

(where n represents an integer from 0 to 5)

(g) alicyclic type/acrylic acid

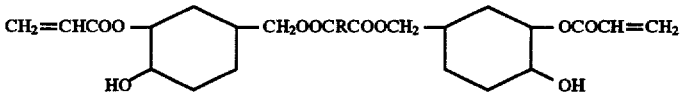

(where R represents $-(CH_2)_n-$ and n represents an integer from 1 to 10)

Polybutadiene acrylate is prepared by a reaction of 1,2-polybutadiene having OH end groups with isocyanate or 1,2-mercaptoethanol followed by a reaction with acrylic acid and so on. Structural formula (h) as an example is shown below.

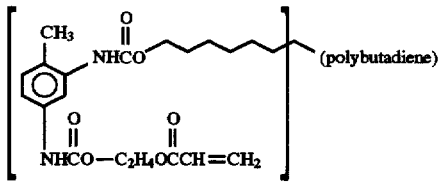

(h)

Silicone acrylate is, for example, prepared by a condensation reaction (demethanol reaction) of organofunctional trimethoxysilane with polysiloxane having silanol groups so as to be methacryl-modified. Its structural formula (i) as an example is shown below.

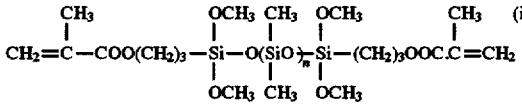

(i)

(where n represents an integer from 10 to 14)

Solvents may be used when the ultraviolet curable resin is used and examples of such solvents include organic solvents such as tetrahydrofuran, methyl ethyl ketone, methyl isobutyl ketone, chloroform, carbon tetrachloride, ethanol, isopropyl alcohol, ethylacetate, butyl acetate, toluene and benzene. Instead of these solvents, a photopolymerizable monomer may be used as a reactive diluent.

Examples of the photopolymerizable monomer include 2-ethylhexyl acrylate, cyclohexyl acrylate, butoxyethyl acrylate, neopentylglycol diacrylate, 1,6-hexanediol diacrylate, polyethyleneglycol diacrylate, trimethylolpropane triacrylate, pentaerythrite acrylate, etc.

The electron beam curable resin is described hereinafter. Any electron curable resins may be used according to the present invention, however, the one whose main component is an electron curable resin having a branched molecular structure having more than five functional groups on a polyester backbone (hereinafter referred to as "electron beam curable acryl-modified polyurethane resin") or a silicone-modified electron beam curable resin is preferable.

The electron beam curable acryl-modified resin may be prepared by a following procedure. That is, by adding diisocyanate and a compound having an acrylic double bond to react with a mixture of polyesterdiol and polyethertriol of a reaction product (which corresponds to polyester backbone) of 1,4-butanediol and adipic acid or of propyleneglycol and adipic acid.

Instead of a mixture of polyesterdiol and polyethertriol, for example, a mixture of polyetherdiol and polyethertriol, a mixture of polyesterdiol and polyestertriol or a mixture of polyetherdiol and polyestertriol may be used.

Examples of diisocyanate include 2,4-tolylenediisocyanate, 2,6-tolylenediisocyanate, 2,6-tolylenediisocyanate, 1,6-hexamethylenediisocyanate, xylenediisocyanate, isophorondiisocyanate, methylenebis (4-phenylisocyanate), etc. Also, examples of the compound having the acrylic double bond include 2-hydroxyethyl (meta)acrylate, 2-hydroxypropyl(meta)acrylate, 3-hydroxypropyl(meta)acrylate, etc. In addition, polyesterdiol is available, for example, as Adeca New Ace Y4-30 (product of Asahi Denka Kogyo Co.) and polyethertriol is available, for example, as Sunnix TP-400 or Sunnix GP-3000 (products of Sanyo Kasei Co.).

The molecular weight of the polyester portion of the electron beam curable acryl-modified polyurethane is preferably in the range of 2000 to 4000 in order to give a required flexibility and strength to a heat resistant slip layer. Also, the total molecular weight of the electron beam curable acryl-modified polyurethane resin is preferably in the range of 20000 to 50000 for the same reason as above. Moreover, improvements in the speed of hardening and the hardness of this resin may be achieved by bringing the number of functional groups to five or more, preferably between seven and thirteen.

On the other hand, the silicone-modified electron beam curable resin has the following structural formula:

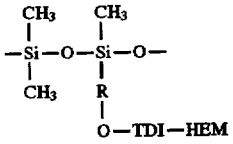

(where R represents $-(CH_2)_n-$(n=0 to 3), TDI and HEM are the abbreviation of 2,4-tolylenediisocyanate and 2-hydroxyethylacrylate, respectively, and x ranges from 50 to 100 and y ranges from three to six.)

The silicone-modified electron beam curable resin has an excellent coating property to form uniform and thin coating and an effective slipping property due to silicone functional groups.

When the electron beam curable acryl-modified polyurethane resin and the electron beam curable silicone-modified resin are used at the same time, the proportion of the electron beam curable silicone-modified resin is up to 30 parts by weight, preferably between 5 to 20 parts by weight, to 100 parts by weight of the electron beam curable acryl modified resin.

It is preferable to use polyfunctional electron curable monomer(s) for the over layer and the protective layer according to the present invention in order to accelerate the hardening and improve the adiabatic effect during the procedure. The monomer(s) acts as a cross-linking stimulator and is advantageous in forming a complicated and high-density cross-linking structure.

Examples of such monomers include trimethylol propanetriacrylate, tetramethylol methanetetraacrylate, pentaerythritol triacrylate, dipentaerythritol hexatriacrylate, etc.

It is preferable to add 50 parts by weight or less, more preferably from 20 to 50 parts by weight, of this monomer to 100 parts by weight of the electron beam curable acryl-modified polyurethane resin. If more than 50 parts by weight of the monomer is added, lubricating effect is weakened and the slipping effect is decreased.

Phosphazene type resin which has a repeating unit of phosphazene backbone as shown below may also be used for the over layer and the protective layer according to the present invention and it has an excellent adiabatic property.

$$-(P{=}N)-$$

A non-limiting concrete example of the above is shown below.

$$-[NP(A)_a(B)_b]_c-$$

(where a and b are real numbers which satisfy a>0, b≧0 and a+b=2, A represents a polymerization curable group such as a methacryloyloxyethyl group and B represents a compound which may be expressed by a following formula;

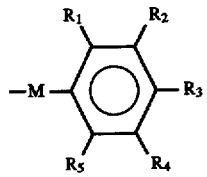

where $R_1$ to $R_5$ represent any one of hydrogen, chlorine, bromine and halogenated alkyl group having 1 to 4 carbon atoms and M represents any one of oxygen, sulfur and imino group.)

Phosphazene type resin having the above structural formula wherein, for example, A is a metacryloyloxyethyl group and b=0, may be obtained by a ring-opening polymerization of a compound having the following formula.

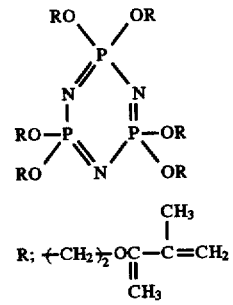

If a resin has the polymerization curable group as in the case of phosphazene type resin having the above structural formula, its mechanical strength, hardness and adiabatic property may be further improved by curing the resin using ultraviolet ray, electron beam, heat and the like.

In order to improve its light resistance, light stabilizers may be added to the over layer and the protective layer according to the present invention as in the case of the thermal recording layer. Examples of the light stabilizer which may be used in the present invention are ultraviolet absorbers, antioxidants, anti-aging agents, extinctive agents of the singlet oxygen and extinctive agents of the superoxide anion and the same agents used for the above-mentioned thermal recording layer are used for the protective layer and the over layer.

The transparent thermal recording medium according to the present invention may be produced by preparing an application liquid for the thermal recording layer using one of the following methods then applying the application liquid on either one side or both sides of the transparent substrate and drying it to produce the thermal recording layer and providing the over layer or the protective layer comprising essentially resin with the thermal recording layer. The methods are: dispersing the developer homogeneously in an organic solvent and then mixing homogeneously the color-producing agent and the binder resin; dispersing the developer homogeneously in an organic solvent in which the binder resin is dissolved then mixing homogeneously the color-producing, etc.; or dispersing the color-producing agent and the developer homogeneously together with the binder resin in an organic solvent.

The organic solvent for dissolving the binder resin may be an ether such as dibutylether, isopropylether, dioxane and tetrahydrofuran; a ketone such as acetone, diethylketone, methylethylketone, methylisobutylketone and methylpropylketone; an ester such as ethyl acetate, isopropyl acetate and n-propyl acetate; an aromatic hydrocarbon such as benzene, toluene and xylene; and they can be used solely or as a mixture.

There are no particular limitations for a coating method of the over layer and the protective layer and the amount of the application liquid, however, from the view points of effect and economy, the thickness of the protective layer on the recording medium should be in the range of 0.1 to 20 μm, preferably in the range of 0.5 to 10 μm so that the over layer or the protective layer may sufficiently achieve its objects and the recording medium may maintain its property as an excellent recording medium.

According to the present invention, a skid layer for improving head matching ability to a thermal head relating to the size accuracy is provided over the protective layer or the over layer, and an electrification prevention layer for improving an antistatic property of the recording medium is also provided. A resin in which silicone segments are joined together blockwise or graftwise is used for the over layer or the skid layer. Since the silicone segments are bonded as such, the contact (frictionless) between the medium and the thermal head may be maintained in an excellent condition, and attachment of dregs to a thermal head may be prevented as the silicone molecules are copolymerized in the resin.

As a silicone segment which is copolymerized with a resin, a compound such as an organopolysiloxane, comprising siloxane bondings as well as alkyl groups such as a methyl group bonded to a silicon atom, having reactive functional groups such as hydroxyl, carboxyl, epoxy, amino and mercapto groups at ends of a molecule or in a molecule, may be employed.

Examples of the resin to which the above mentioned silicone segments, joined together blockwise or graftwise, are bonded to its principle chain include a thermoplastic resin such as poly(met)acrylate ester resin, polyvinyl butyral resin, polyvinyl acetoacetal resin, ethyl cellulose, methyl cellulose, cellulose acetate, hydroxyethyl cellulose, cellulose acetate propionate, polyurethane type resin, polyester type resin, polyvinyl acetate type resin, styrene acrylate type resin, polyolefin type resin, polystyrene type resin, polyvinyl chloride type resin, polyether type resin, polyamide type resin, polycarbonate type resin, polyethylene resin, polypropylene resin and polyacrylamide resin. Among these resins, poly(met)acrylate ester resin, polyvinyl butyral resin, polyvinyl acetoacetal resin, ethyl cellulose, cellulose acetate propionate and polyurethane type resin are preferable in terms of its heat resistance property and solubility to a solvent.

Amount of the silicone segment contained in the thus silicone modified resin is preferably between one to 30 weight %. If the amount is less than one weight %, the skid property of the layer is lowered and problems such as a sticking of the recording media to the thermal head tend to be generated. If the amount is more than 30 weight %, a bonding property and an adhesive property of the resin is lowered and problems such as attachment of dregs to the thermal head may easily be generated. Also, since these silicone modified resins have a skid property, they may be used solely as the over layer or the skid layer, or as a main component of these layer. Moreover, it is possible to add known inorganic or organic fillers, slip additives and other resins to the resin if necessary.

One or a mixture of two or more of the above mentioned inorganic or organic fillers conventionally used for a thermal recording material may be employed in the present invention. Examples of such fillers include inorganic fillers such as calcium carbonate, silica, zinc oxide, titanium oxide, aluminum hydroxide, zinc hydroxide, barium sulfate, kaolinite, clay, talc and surface-treated calcium or silica, and organic fillers such as urea-formalin resin, styrene/methacryl acid copolymer, silicone resin and polystyrene resin. A method for applying the skid layer is not particularly limited and any known methods by which the above mentioned surface property of the layer is acquired may be used. The thickness of the skid layer is preferably from 0.1 to 20 μm and more preferably from 0.5 to 10 μm. If the thickness of the skid layer is too thin, function of the layer such as the head matching ability is lowered. If the thickness of the skid layer is too thick, the thermosensitivity of the recording medium is deteriorated and cost is increased.

Materials which may be used for the electrification prevention layer are limited by the requirement that the surface resistance of the layer must not exceed $10^8\Omega$ even under a low humidity condition, and electroconductive metal oxides are added in general. Although an antistatic agent to which the electroconductive metal oxide is added is generally expensive, it has an excellent electrification prevention property since the metal oxide per se has the electroconductivity, and it does not affect the transparency of the recording medium.

Non-limiting examples of such electroconductive metal oxides include $SnO_2$, $In_2O_3$, ZnO, $TiO_2$, MgO, $Al_2O_3$, BaO and $MoO_3$. They may be used solely or as a mixture with P, Sb, Sn, Zn and so on. It is preferable that the size of particles of these metal oxides is small, and the smaller it becomes, the better the transparency of the media. According to the present invention, an antistatic agent whose average particle size is equal to or less than 0.2 μm is used to realize the excellent transparency.

Moreover, examples of a binder used with the metal oxides include water-soluble resin, aqueous emulsion, hydrophobic resin, ultraviolet curable resin and electron beam curable resin.

Examples of the water-soluble resin include polyvinyl alcohol, cellulose derivatives, casein, gelatin, styrene-maleic anhydride and carboxyl modified polyethylene resin.

Examples of the aqueous emulsion and the hydrophobic resin include polyvinyl acetate, polyurethane, vinyl chloride/vinyl acetate copolymer, polyester, polybutyl acrylate, polyvinyl butyral, polyvinyl acetal and ethylene/vinyl acetate copolymer. They may be used solely or as a mixture and, if necessary, a curing agent may be added to the resin.

Any known monomers, oligomers or prepolymers which can be cured by an irradiation of the ultraviolet light may be used as an ultraviolet curable resin according to the present invention. Similarly, the electron beam curable resin according to the present invention is not limited, however, it is preferable to employ an electron beam curable resin having at least a five functionality in a branched chain molecular structure with a polyester backbone. As for a ratio of the binder in relation to the metal oxide, it is preferable to add 0.05 to 1 part by weight of the metal oxide to 1 part by weight of the binder, and it is more preferable to add 0.2 to 0.8 part by weight of the metal oxide to 1 part by weight of the binder.

The formation of a recording image on the transparent thermal recording medium of the present invention may be achieved, depending on the purposes, by using a thermal pen, a thermal head, laser heating, thermal etching with light, etc., and not particularly limited. In practice, however, it is preferable to employ the thermal head to form an image.

In the following, a principle of the present invention is described with reference to Examples.

EXAMPLES

The present invention is described in detail using examples hereinafter. Note that the terms "parts" and "%" used in the following examples are based on weight unless otherwise noted.

[Example 1]

Application liquid for the recording layer is prepared by dispersing the following compositions using a bench type ball mill until the mean particle size of octadecylphosphonic acid becomes 0.3 μm.

| [Application liquid for the recording layer] | |
|---|---|
| 3-diethylamino-6-methyl-7-anilinofluoran | 10 parts |
| Octadecylphosphonic acid | 30 parts |
| Polyvinyl butyral [refractive index = 1.49] (Denka butyral #3000-2 produced by Denka Kagaku Kogyo Co.) | 15 parts |
| 1:1 mixture of toluene/ methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.49] in acetate-n-butyl solution (Unideck C7-157 of Dainihon Ink Kagaku Co.) | 100 parts |
| 52% silicone resin in xylene (Byk-344 produced by BicChemy Japan Co.) | 1 parts |
| Ethylacetate | 50 parts |
| [Application liquid for the skid layer] | |
| Silicon modified acryl resin (Toa Gosei Co., US-350, 30% solid component) | 35 parts |
| Methylethylketone | 115 parts |

[Production of transparent thermal recording medium]

The application liquid for the recording layer is applied onto the HMW polyester film of a 75 μm thickness (produced by Teijin Co.) using a wired-bar so that the thickness of the layer becomes about 8.0 μm. After drying, a thermal recording layer is produced. Then, the application liquid for the protective layer is applied onto the recording layer using the wired-bar. After drying, the layer is cured using a 80 W/cm ultraviolet ray lamp to produce a protective layer of about 3.0 μm thickness. Then the application liquid for the skid layer is applied onto the protective layer and dried to produce a skid layer of about 1 μm thickness. The thermal recording medium of the Example 1 is thus produced.

[Example 2]

Application liquid for the recording layer is prepared by dispersing the following compositions using a bench type ball mill until the mean particle size of octadecylphosphonic acid becomes about 0.3 μm.

| [Application liquid for the recording layer] | |
|---|---|
| 2-(o-chlorophenylamino)-6-ethylamino-7-methylfluoran | 10 parts |
| Octadecylphosphonic acid | 30 parts |
| Polyvinyl butyral [refractive index = 1.49] (Denka butyral #3000-2 produced by Denka Kagaku Kogyo Co.) | 15 parts |
| 1:1 mixture of toluene/ methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.56] in acetate-n-butyl solution (Unideck C7-157 of Dainihon Ink Kagaku Co.) | 100 parts |
| 52% silicone resin in xylene (Byk-344 produced by BicChemy Japan Co.) | 4 parts |
| Ethylacetate | 50 parts |
| [Application liquid for the skid layer] | |
| Silicon modified acryl resin (Toa Gosei Co., US-350, 30% solid component) | 35 parts |
| Methylethylketone | 115 parts |
| [Application liquid for the electrification prevention layer] | |
| $SnO_2$-Sb/vinyl chloride resin (Syokubai Kasei Kogyo, ELCOM3519-3) | 20 parts |
| Toluene/methylethylketone | 80 parts |

[Production of transparent thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes 8.0 μm after drying. After the thermal recording layer is produced, the application liquid for the protective layer is applied onto the recording layer using the wired-bar. After drying, the layer is cured using a 80 W/cm ultraviolet ray lamp to produce a protective layer of about 2.0 μm thickness. Then the application liquid for the skid layer is applied onto the protective layer. After drying the skid layer of about 1.5 μm thickness is formed and the thermal recording medium of the Example 2 is produced.

[Example 3]

Application liquid for the recording layer is prepared by dispersing the following compositions using a bench type ball mill until the mean particle size of eicosylphosphonic acid becomes 0.3 μm.

| [Application liquid for the recording layer] | |
|---|---|
| 2-(o-chlorophenylamino-6-n octylaminofluoran | 10 parts |
| Eicosylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/ methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.56] in acetate-n-butyl solution (Unideck C7-157 of Dainihon Ink Kagaku Co.) | 100 parts |
| 52% silicone resin in xylene (Byk-344 produced by BicChemy Japan Co.) | 14 parts |
| Ethylacetate | 50 parts |
| [Application liquid for the skid layer] | |
| Silicon modified polyvinyl butyral resin (Dainichi Seika Co., SP-712, 12.5% solid component) | 84 parts |
| Methylethylketone | 66 parts |
| [Application liquid for the electrification prevention layer] | |
| $SnO_2$-Sb/vinyl chloride resin (Syokubai Kasei Kogyo, ELCOM3519-3) | 20 parts |
| Toluene/methylethylketone | 80 parts |

[Production of transparent thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes 8.0 μm after drying. After the thermal recording layer is produced, the application liquid for the protective layer is applied onto the recording layer using the wired-bar. After drying, the layer is cured using a 80 W/cm ultraviolet ray lamp to produce a protective layer of about 2.0 μm thickness. Then the application liquid for the skid layer is applied onto the protective layer. After drying the skid layer of about 1.5 μm thickness is formed and the thermal recording medium of the Example 3 is produced.

[Example 4]

Application liquid for the recording layer is prepared by dispersing the following compositions using a bench type ball mill until the mean particle size of eicosylphosphonic acid becomes 0.3 μm.

| [Application liquid for the recording layer] | |
|---|---|
| 2-(o-nitrophenylamino-6-diethylaminofluoran | 10 parts |
| Eicosylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/ methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.56] in acetate-n-butyl solution (Unideck C7-157 of Dainihon Ink Kagaku Co.) | 100 parts |
| 52% silicone resin in xylene (Byk-344 produced by BicChemy Japan Co.) | 14 parts |
| Ethylacetate | 50 parts |
| [Application liquid for the skid layer] | |
| Silicon modified polyvinyl acetoacetal resin (20 wt % of silicon segment content, 27% solid component) | 39 parts |
| Methylethylketone | 111 parts |
| [Application liquid for the electrification prevention layer) | |
| $SnO_2$-Sb/vinyl chloride resin (Syokubai Kasei Kogyo, ELCOM3519-3) | 20 parts |
| Toluene/methylethylketone | 80 parts |

[Production of transparent thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes 8.0 μm after drying. After the thermal recording layer is produced, the application liquid for the protective layer is applied onto the recording layer using the wired-bar. After drying, the layer is cured using a 80 W/cm ultraviolet ray lamp to produce a protective layer of about 2.0 μm thickness. Then the application liquid for the skid layer is applied onto the protective layer. After drying the skid layer of about 1.5 μm thickness is formed and the thermal recording medium of the Example 4 is produced.

[Example 5]

Application liquid for the recording layer is prepared by dispersing the following compositions using a bench type ball mill until the mean particle size of octadecylphosphonic acid becomes 0.3 μm.

| [Application liquid for the recording layer] | |
|---|---|
| 2-amino-3-methyl-6-butylaminofluoran | 10 parts |
| Octadecylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/ methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.56] in acetate-n-butyl solution (Unideck C7-157 of Dainihon Ink Kagaku Co.) | 100 parts |
| 52% silicone resin in xylene (Byk-344 produced by BicChemy Japan Co.) | 14 parts |
| Ethylacetate | 50 parts |

-continued

| [Application liquid for the skid layer] | |
|---|---|
| Silicon modified cellulose acetate-propionate (20 wt % of silicon segment content, 30% solid component) | 35 parts |
| Methylethylketone | 115 parts |
| [Application liquid for the electrification prevention layer] | |
| $SnO_2$-Sb/vinyl chloride resin (Syokubai Kasei Kogyo, ELCOM3519-3) | 20 parts |
| Toluene/methylethylketone | 80 parts |

[Production of transparent thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes 8.0 μm after drying. After the thermal recording layer is produced, the application liquid for the protective layer is applied onto the recording layer using the wired-bar. After drying, the layer is cured using a 80 W/cm ultraviolet ray lamp to produce a protective layer of about 2.0 μm thickness. Then the application liquid for the skid layer is applied onto the protective layer. After drying the skid layer of about 1.5 μm thickness is formed and the thermal recording medium of the Example 5 is produced.

[Example 6]

Application liquid for the recording layer is prepared by dispersing the following compositions using a bench type ball mill until the mean particle size of octadecylphosphonic acid becomes 0.3 μm.

| [Application liquid for the recording layer] | |
|---|---|
| 2-phenylamino-3-methyl-6-n-butylamino-fluoran | 10 parts |
| Octadecylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.56] in acetate-n-butyl solution (Unideck C7-157 of Dainihon Ink Kagaku Co.) | 100 parts |
| 52% silicone resin in xylene (Byk-344 produced by BicChemy Japan Co.) | 14 parts |
| Ethylacetate | 50 parts |
| [Application liquid for the skid layer] | |
| Silicon modified ethyl cellulose (20 wt % of silicon segment content, 32% solid component) | 33 parts |
| Methylethylketone | 115 parts |

-continued

| [Application liquid for the electrification prevention layer] | |
|---|---|
| $SnO_2$-Sb/vinyl chloride resin (Syokubai Kasei Kogyo, ELCOM3519-3) | 20 parts |
| Toluene/methylethylketone | 80 parts |

[Production of transparent thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes 8.0 μm after drying. After the thermal recording layer is produced, the application liquid for the protective layer is applied onto the recording layer using the wired-bar. After drying, the layer is cured using a 80 W/cm ultraviolet ray lamp to produce a protective layer of about 2.0 μm thickness. Then the application liquid for the skid layer is applied onto the protective layer. After drying the skid layer of about 1.5 μm thickness is formed and the thermal recording medium of the Example 6 is produced.

[Example 7]

Application liquid for the recording layer is prepared by dispersing the following compositions using a bench type ball mill until the mean particle size of octadecylphosphonic acid becomes 0.3 μm.

| [Application liquid for the recording layer] | |
|---|---|
| 2-(N-methyl-N-3'-chlorophenylamino)-6-ethylamino-7-methylfluoran | 10 parts |
| Octadecylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/methylethylketone | 285 parts |

Application liquid for the protective layer is prepared by homogeneously dispersing the following compositions.

| [Application liquid for the protective layer] | |
|---|---|
| 75% urethane acrylate ultraviolet curable resin [refractive index = 1.56] in acetate-n-butyl solution (Unideck C7-157 of Dainihon Ink Kagaku Co.) | 100 parts |
| 52% silicone resin in xylene (Byk-344 produced by BicChemy Japan Co.) | 14 parts |
| Ethylacetate | 50 parts |
| [Application liquid for the skid layer] | |
| Silicon modified ethyl cellulose (8 wt % of silicon segment content, 22% solid component) | 48 parts |
| Methylethylketone | 102 parts |
| [Application liquid for the electrification prevention layer] | |
| $SnO_2$-Sb/vinyl chloride resin (Syokubai Kasei Kogyo, ELCOM3519-3) | 20 parts |
| Toluene/methylethylketone | 80 parts |

[Production of transparent thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes 8.0 μm after drying. After the thermal recording layer is produced, the application liquid for the protective layer is applied onto the recording layer using the wired-bar. After drying, the layer is cured using a 80 W/cm ultraviolet ray lamp to produce a protective layer of about 2.0 μm thickness. Then the application liquid for the skid layer is applied onto the protective layer. After drying the skid layer of about 1.5 μm thickness is formed and the thermal recording medium of the Example 7 is produced.

[Example 8]

Application liquid for the recording layer is prepared by dispersing the following compositions using a bench type ball mill until the mean particle size of octadecylphosphonic acid becomes 0.3 μm.

| [Application liquid for the recording layer] | |
|---|---|
| 2-(o-chlorophenylamino)-6-ethylamino-7-methylfluoran | 10 parts |
| Octadecylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/methylethylketone | 285 parts |

Application liquid for an over layer (having the function of the protective layer and the skid layer) is prepared by homogeneously dispersing the following solutions A and B until the mean particle size becomes about 0.5 μm and by further mixing the resultant solution with the solution C.

| [Application liquid for the over layer] | |
|---|---|
| Solution A | |
| Kaolin (UW-90 produced by Hishisan shoji Co.) | 33 parts |
| Silicone modified polyvinyl butyral resin (SP-712 produced by Dainichiseika Co. 12.5% solid component) | 26 parts |
| Methylethylketone | 41 parts |
| Solution B | |
| Zink stearate | 3.3 parts |
| Silicone modified polyvinyl butyral resin (SP-712 produced by Dainichiseika Co. 12.5% solid component) | 2.6 parts |
| Methylethylketone | 4.1 parts |
| Solution C | |
| Silicone modified polyvinyl butyral resin (SP-712 produced by Dainichiseika Co. 12.5% solid component) | 66 parts |
| Urethane acrylate ultraviolet curable resin solution [refractive index = 1.56] (Unideck V9057 of Dainihon Ink Kagaku Co. 75% solid component) | 15 parts |
| Silicone oil (SH29PA produced by Tore silicone Co.) | 1.5 parts |
| Polyisocyanate compound (Colonate L produced by Nihon Polyurethane Kogyo Co., Ltd.) | 11.5 parts |
| 1:1 mixture of toluene/methylethylketone | 200 parts |

-continued

| [Application liquid for the electrification prevention layer] | |
|---|---|
| $SnO_2$-Sb/polyester emulsion dispersion ColcoatSP-2002 produced by Colcoat Co., Ltd.) | 10 parts |
| 1:2 mixture of water/methanol | 90 parts |

[Production of thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes about 13 μm after drying. After the thermal recording layer is produced, the application liquid for the over layer is applied onto the recording layer using the wired-bar. After drying, the layer is cured using a 80 W/cm ultraviolet ray lamp to produce an over layer of about 3 μm thickness. The thermal recording medium of the Example 8 is thus produced.

[Example 9]

Application liquid for the recording layer is prepared by dispersing the following compositions using a bench type ball mill until the mean particle size of octadecylphosphonic acid becomes 0.3 μm.

| [Application liquid for the recording layer) | |
|---|---|
| 2-(o-chlorophenylamino)-6-ethylamino-7-methylfluoran | 10 parts |
| Octadecylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/methylethylketone | 285 parts |

Application liquid for an over layer is prepared by homogeneously dispersing the following solutions A and B until the mean particle size becomes about 0.5 μm and by further mixing the resultant solution with the solution C.

| [Application liquid for the over layer] | |
|---|---|
| Solution A | |
| Kaolin (UW-90 produced by Hishisan shoji Co.) | 33 parts |
| Silicone modified polyvinyl butyral resin (SP-712 produced by Dainichiseika Co. 12.5% solid component) | 26 parts |
| Methylethylketone | 41 parts |
| Solution B | |
| Zink stearate | 3.3 parts |
| Silicone modified polyvinyl butyral resin (SP-712 produced by Dainichiseika Co. 12.5% solid component) | 2.6 parts |
| Methylethylketone | 4.1 parts |
| Solution C | |
| Silicone modified polyvinyl butyral resin (SP-712 produced by Dainichiseika Co. 12.5% solid component) | 150 parts |

-continued

| | |
|---|---|
| Urethane acrylate ultraviolet curable resin solution [refractive index = 1.56] (Unideck V9057 of Dainihon Ink Kagaku Co. 75% solid component) | 135 parts |
| Silicone resin fine powder (Tospearl105 produced by Tore silicone Co.) | 15 parts |
| Silicone oil (SH29PA produced by Tore silicone Co.) | 1.5 parts |
| Polyisocyanate compound (Colonate HL produced by Nihon Polyurethane Kogyo Co., Ltd.) | 20 parts |
| 1:1 mixture of toluene/ methylethylketone | 180 parts |
| [Application liquid for the electrification prevention layer] | |
| $SnO_2$-Sb/polyester emulsion dispersion ColcoatSP-2002 produced by Colcoat Co., Ltd.) | 10 parts |
| 1:2 mixture of water/methanol | 90 parts |

[Production of thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes about 13 μm after drying. After the thermal recording layer is produced, the application liquid for the over layer is applied onto the recording layer using the wired-bar. After drying, the layer is cured using a 80 W/cm ultraviolet ray lamp to produce an over layer of about 3 μm thickness. The thermal recording medium of the Example 9 is thus produced.

[Example 10]

Application liquid for the recording layer is prepared by dispersing the following compositions using a bench type ball mill until the mean particle size of octadecylphosphonic acid becomes 0.3 μm.

| [Application liquid for the recording layer) | |
|---|---|
| 2-(o-chlorophenylamino)-6-ethylamino-7-methylfluoran | 10 parts |
| Octadecylphosphonic acid | 30 parts |
| Polyvinyl butyral [refractive index = 1.49] (Denka butyral #3000-2 produced by Denki Kagaku Kogyo Co.) | 15 parts |
| 1:1 mixture of toluene/ methylethylketone | 285 parts |

Application liquid for an over layer is prepared by homogeneously dispersing the following solutions A and B until the mean particle size becomes about 0.5 μm and by further mixing the resultant solution with the solution C.

| [Application liquid for the over layer] | |
|---|---|
| Solution A | |
| Urea-formalin type organic filler (produced by Nihon Kasei Co.) | 33 parts |
| Silicone modified polyvinyl butyral resin (SP-712 produced by Dainichiseika Co. 12.5% solid component) | 26 parts |
| Methylethylketone | 41 parts |
| Solution B | |
| Zink stearate | 3.3 parts |
| Silicone modified polyvinyl butyral resin (SP-712 produced by Dainichiseika Co. 12.5% solid component) | 2.6 parts |
| Methylethylketone | 4.1 parts |
| Solution C | |
| Silicone modified polyvinyl butyral resin (SP-712 produced by Dainichiseika Co. 12.5% solid component) | 150 parts |
| Urethane acrylate ultraviolet curable resin solution [refractive index = 1.56] (Unideck V9057 of Dainihon Ink Kagaku Co. 75% solid component) | 135 parts |
| Silicone resin fine powder (Tospearl105 produced by Tore silicone Co.) | 15 parts |
| Silicone oil (SH29PA produced by Tore silicone Co.) | 1.5 parts |
| Polyisocyanate compound (Colonate HL produced by Nihon Polyurethane Kogyo Co., Ltd.) | 20 parts |
| 1:1 mixture of toluene/ methylethylketone | 180 parts |
| [Application liquid for the electrification prevention layer] | |
| $SnO_2$-Sb/polyester emulsion dispersion ColcoatSP-2002 produced by Colcoat Co., Ltd.) | 10 parts |
| 1:2 mixture of water/methanol | 90 parts |

[Production of thermal recording medium]

The application liquid for the electrification prevention layer is applied to one surface of Merinex 705 polyester film of 75 μm thickness (produced by ICI Japan Co.) using a wired-bar and dried to produce an electrification prevention layer of about 0.3 μm. Then the application liquid for the recording layer is applied onto the reverse side of the film using the wired-bar so that the thickness of the layer becomes about 13 μm after drying. After the thermal recording layer is produced, the application liquid for the over layer is applied onto the recording layer using the wired-bar. After drying, the layer is cured using a 80 W/cm ultraviolet ray lamp to produce an over layer of about 3 μm thickness. The thermal recording medium of the Example 10 is thus produced.

[Comparative Example 1]

Thermal recording medium is produced using the same manner in the Example 1 except that the skid layer is formed on the reverse side of the recording layer.

[Comparative Example 2]

Thermal recording medium is produce using the same manner in the Example 2 except that the following solution D is employed in stead of the application liquid for the skid layer used in the Example 2.

| Solution D | |
|---|---|
| Polyvinyl acetoacetal resin powder (Slec-KS produced by Sekisui Kagaku Co.) | 6.5 parts |
| Tore silicone SR-2411 (produced by Tore silicone) | 0.5 parts |
| Methylethylketone | 93 parts |

The thermal recording media thus produced were evaluated according to the following items:

[Dynamic friction coefficient]

The dynamic friction coefficients of both sides of the thermal recording medium were measured using a dynamic friction coefficient measuring device (Kyowa Kaimen Kagaku Co., Ltd.) using the following condition:

A stainless ball of 3 mm diameter was put on a surface of a sample horizontally placed at normal temperature and the ball was moved at a speed of 1.0 mm/sec. for 10 mm with an applied load of 50 g.

[Surface resistance value (the reverse side was measured)]

The surface resistance value of the reverse side of the transparent thermal recording layer was measured using a surface resistance measuring device (Hewlett Packard 4329A Height Resistance Meter) using the following condition:

Discharge: 1 minute; Charge 1 minute; Measurement: 1 minute; Applied Voltage: 10 V; Environmental condition: 5° C., 30% RH; and the surface resistance value was obtained by multiplying the measured value by 18.8.

[Image density]

Each of the recording media was printed with black ink using a thermal printing simulator (Okura Denki Co.) with a following condition:

Thermal head dot density: 8 dot/mm,

Applied voltage: 0.68 W/dot,

Pulse width: 0.50 msec,

Line cycle: 10 msec/line, and

Printing length: 20 cm.

Transmittance density of printed image was measured by a densitometer X-Rite309 (manufactured by X-RITE COMPANY) using a UV filter.

[Size accuracy]

As described in the above section of "Image density", each of the recording media (two pieces each) was printed using the thermal printing simulator (Okura Denki Co.) and the difference of the printing length between the two pieces of the media were measured using a 1st class JIS (Japan Industrial Standard) ruler. The results were evaluated using the following criteria:

| | |
|---|---|
| Difference less than 0.2 mm | A |
| Difference equal to or more than 0.2 mm and less than 0.5 mm | B |
| Difference equal to or more than 0.5 mm | C |

[Surface characteristic]

As described in the above section of "Image density", each of the recording media was printed using the thermal printing simulator (Okura Denki Co.) using the same condition and under 5° C. and 30% RH. The surface characteristic of each of the thermal recording media was observed visually.

| | |
|---|---|
| No particular problems observed | A (good) |
| A few problems observed | B (problematic) |
| Significant problems observed | C (bad) |

Results of the above mentioned evaluations are tabulated in the following Table. In addition, it is understood that the present invention is not limited by any means to the above-mentioned examples, but variations and modifications may be made without departing from the scope of the present invention.

| Item sample | Dynamic friction coefficient of printing surface | Dynamic friction coefficient of reverse side | Surface resistance value (Ω) | Image density | Size accuracy | Surface characteristic |
|---|---|---|---|---|---|---|
| Ex. 1 | 0.034 | 0.32 | ∞ | 1.38 | B | B |
| Ex. 2 | 0.032 | 0.22 | $\leqq 7.5 \times 10^7$ | 2.02 | A | A |
| Ex. 3 | 0.024 | 0.22 | $\leqq 7.5 \times 10^7$ | 1.93 | A | A |
| Ex. 4 | 0.042 | 0.22 | $\leqq 7.5 \times 10^7$ | 1.97 | A | A |
| Ex. 5 | 0.043 | 0.22 | $\leqq 7.5 \times 10^7$ | 1.83 | A | A |
| Ex. 6 | 0.031 | 0.22 | $\leqq 7.5 \times 10^7$ | 2.05 | A | A |
| Ex. 7 | 0.035 | 0.22 | $\leqq 7.5 \times 10^7$ | 1.99 | A | A |
| Ex. 8 | 0.092 | 0.22 | $\leqq 7.5 \times 10^7$ | 3.04 | A | A |
| Ex. 9 | 0.081 | 0.22 | $\leqq 7.5 \times 10^7$ | 3.05 | A | A |
| Ex. 10 | 0.074 | 0.22 | $\leqq 7.5 \times 10^7$ | 3.01 | A | A |
| Com. 1 | 0.073 | 0.032 | ∞ | 1.39 | C | C |
| Com. 2 | 0.153 | 0.22 | $\leqq 7.5 \times 10^7$ | 1.99 | C | B |

$\infty \geqq 9.4 \times 10^{15}\Omega$

What is claimed is:

1. A thermal recording medium, comprising:

a thermal recording layer provided on a transparent substrate, consisting essentially of an electron-donating chromophoric compound, an electron-accepting compound and a binder resin, and an over layer, having a surface dynamic friction coefficient no greater than about 0.1, comprising a resin having a refractive index substantially the same as a refractive index of said thermal recording layer, wherein said over layer is comprised of a protective layer and a skid layer and said skid layer has a dynamic friction coefficient which does not exceed about 0.05.

2. The thermal recording medium as claimed in claim 1, wherein the dynamic friction coefficient of a reverse side of said thermal recording medium is at least about 0.1.

3. The thermal recording medium as claimed in claim 1, wherein a surface resistance value of a reverse side of said thermal recording medium does not exceed about $10^8$ Ω.

4. The thermal recording medium as claimed in claim 1, wherein said skid layer is comprised of a resin in which silicone segments are joined together in one of block-wise and graftwise.

5. The thermal recording medium as claimed in claim 4, wherein said resin is selected from a group consisting of an acrylate resin in which silicone segments are joined together in one of blockwise and graftwise, a methacrylate resin in which silicone segments are joined together in one of blockwise and graftwise, polyvinyl butyral resin in which silicone segments are joined together in one of blockwise and graftwise, polyvinyl acetate resin in which silicone segments are joined together in one of blockwise and graftwise, cellulose acetate propionate resin in which silicone segments are joined together in one of blockwise and graftwise, ethyl cellulose resin in which silicone segments are joined together in one of blockwise and graftwise and polyurethane type resin in which silicone segments are joined together in one of blockwise and graftwise.

6. The thermal recording medium as claimed in claim 1, wherein said binder resin contains one of hydroxyl groups and carboxyl groups in a molecule thereof and has a refractive index ranging from about 1.45 to 1.60 at ordinary temperature.

7. The thermal recording medium as claimed in claim 1, wherein an electrification prevention layer is further provided with a reverse side of said thermal recording medium.

8. A thermal recording medium comprising:

a thermal recording layer provided on a transparent substrate, consisting essentially of an electron-donating chromophoric compound, an electron-accepting compound and a binder resin, and an over layer comprising a resin having a refractive index substantially the same as a refractive index of said thermal recording layer, wherein said over layer includes a skid compound whereby the over layer has a surface dynamic friction coefficient of no greater than about 0.1.

9. The thermal recording medium as claimed in claim 8, wherein said skid compound is a resin in which silicone segments are joined together in one of blockwise and graftwise.

10. The thermal recording medium as claimed in claim 9, wherein said resin is selected from a group consisting of an acrylate resin in which silicone segments are joined together in one of blockwise and graftwise, a methacrylate resin in which silicone segments are joined together in one of blockwise and graftwise, polyvinyl butyral resin in which silicone segments are joined together in one of blockwise and graftwise, polyvinyl acetal resin in which silicone segments are joined together in one of blockwise and graftwise, cellulose acetate propionate resin in which silicone segments are joined together in one of blockwise and graftwise, ethyl cellulose resin in which silicone segments are joined together in one of blockwise and graftwise and polyurethane type resin in which silicone segments are joined together in one of blockwise and graftwise.

11. The thermal recording medium as claimed in claim 8, wherein the dynamic friction coefficient of a reverse side of said thermal recording medium is at least about 0.1.

12. The thermal recording medium as claimed in claim 8, wherein a surface resistance value of a reverse side of said thermal recording medium does not exceed about $10^8$ Ω.

13. The thermal recording medium as claimed in claim 8, wherein said binder resin contains one of hydroxyl groups and carboxyl groups in a molecule thereof and has a refractive index ranging from about 1.45 to 1.60 at ordinary temperature.

14. The thermal recording medium as claimed in claim 8, wherein an electrification prevention layer is further provided with a reverse side of said thermal recording medium.

* * * * *